US008870447B2

(12) United States Patent
Born et al.

(10) Patent No.: US 8,870,447 B2
(45) Date of Patent: Oct. 28, 2014

(54) SOLAR ELECTRIC WINDER FOR A SELF-WINDING WATCH

(71) Applicant: The Swatch Group Research and Development Ltd, Marin (CH)

(72) Inventors: Jean-Jacques Born, Morges (CH); Beat Gilomen, Grenchen (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 14/109,209

(22) Filed: Dec. 17, 2013

(65) Prior Publication Data

US 2014/0177400 A1 Jun. 26, 2014

(30) Foreign Application Priority Data

Dec. 21, 2012 (EP) ..... 12198819

(51) Int. Cl.
*G04B 5/00* (2006.01)
*G04C 1/00* (2006.01)

(52) U.S. Cl.
CPC ..... *G04C 1/00* (2013.01)
USPC ..... 368/207

(58) Field of Classification Search
USPC ..... 368/207, 227, 239, 67, 66, 88, 204, 47, 368/276, 83, 205, 240
See application file for complete search history.

(56) References Cited

U.S. PATENT DOCUMENTS

| | | | | |
|---|---|---|---|---|
| 3,757,511 | A * | 9/1973 | Burgess et al. | 368/83 |
| 7,054,233 | B2 * | 5/2006 | Kibiloski et al. | 368/67 |
| 2004/0047244 | A1 * | 3/2004 | Iino et al. | 368/276 |
| 2008/0225648 | A1 * | 9/2008 | Kawaguchi | 368/66 |
| 2009/0201771 | A1 * | 8/2009 | Miyahara | 368/47 |

FOREIGN PATENT DOCUMENTS

| | | | |
|---|---|---|---|
| DE | 195 35 229 | A1 | 4/1997 |
| EP | 0 392 980 | A1 | 10/1990 |
| EP | 2 481 322 | A1 | 8/2012 |

OTHER PUBLICATIONS

European Search Report issued May 17, 2013, in European Application No. 12 19 8819 filed Dec. 21, 2012 (with English Translation), 4 pages.

* cited by examiner

*Primary Examiner* — Edwin A. Leon
(74) *Attorney, Agent, or Firm* — Oblon, Spivak, McClelland, Maier & Neustadt, L.L.P.

(57) ABSTRACT

The electric solar watch winder includes a rotating support, a motor arranged to drive the rotating support, an accumulator arranged to power the motor, a solar cell arranged to charge the accumulator, an internal clock, an electronic means of controlling the motor, a light sensor connected to the electronic means, and a user control interface for the electronic means. The electronic means is arranged to be controlled by the user to be selectively placed in one or other of a plurality of operating modes, the plurality of operating modes including a first mode in which the rotating support is only driven when the winding mechanism is illuminated and a second mode in which a rotating support drive program is started at a pre-selected time using the control interface.

6 Claims, 1 Drawing Sheet

SOLAR ELECTRIC WINDER FOR A SELF-WINDING WATCH

This application claims priority from European Patent Application No. 12198819.0 filed 21 Dec. 2012, the entire disclosure of which is incorporated herein by reference.

FIELD OF THE INVENTION

The present invention concerns an electric winder for a self-winding watch, the winder including an electric motor, an accumulator arranged to power the motor, a solar cell arranged to charge the accumulator, an internal clock, an electronic means of controlling the motor, and a user control interface for the electronic means. The present invention more specifically concerns a winder of this type adapted also to serve as a display stand for the self-winding watch.

PRIOR ART

Electric watch winders are already known. These winders are devices which may be used to prevent a self-winding watch from stopping when it is not worn for a certain period of time. Self-winding watches are fitted with a mechanism which automatically winds the mainspring using the arm movements of the person wearing the watch as the drive force. When a self-winding watch is worn, the movements cause an oscillating weight provided for this purpose to rotate or oscillate inside the watch. The oscillating weight is in turn arranged to transmit the energy which moves it to a gear train which winds the mainspring. It will thus be clear that a self-winding watch which remains immobile is not wound.

One place where a watch is especially likely to remain immobile for a long time is in a store window. Indeed, it is not unusual for a large number of watches to be statically displayed in watch store window displays. The use of an electric winding mechanism is thus particularly advantageous in this environment. EP Patent No 2 481 322 discloses an electric winder adapted to also be used as a watch display stand in a retailer's window. The electric winder disclosed in this prior art document is formed of a base on which there are arranged two upright members which carry a support element arranged to hold a watch. The support element is pivotally mounted between the upright members, and an electric motor installed in the base allows the support element to be rotated via a drive belt. According to the aforementioned prior art document, the rotation of the support element provides observers with a dynamic display of a self-winding watch, while winding the watch at the same time. Finally it should be specified that the energy required for the operation of this prior art electric winder may either be delivered via the mains electricity current, or from solar cells arranged on the surface of the base.

The winder that has just been described has certain drawbacks. In particular, the document explains that the movement of the support element is arranged to be permanent. In this respect, it is known that an electric winder is not liable to wind a watch beyond the maximum spring tension. Indeed, the mainspring of a self-winding watch is normally provided with a slip spring. This slip spring is arranged to allow the spring to be wound normally, but to slide against the walls of the drum as soon as the spring tension reaches a certain limit. In any event, the permanent winding described in the aforementioned document is not advisable. In fact this type of winding has the disadvantage of causing accelerated wear of the automatic winder. Moreover, lovers of fine watches often prefer to examine a timepiece displayed in a static manner.

BRIEF SUMMARY OF THE INVENTION

It is an object of the present invention to overcome the aforementioned drawbacks of the prior art by providing an electric winder for a self-winding watch powered by a solar cell, and suitable for simultaneously performing the functions of winding and static display during the store opening hours. The present invention achieves this object by providing an electric winder for a self-winding watch mechanism in accordance with the annexed claim 1.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

Figure 1:
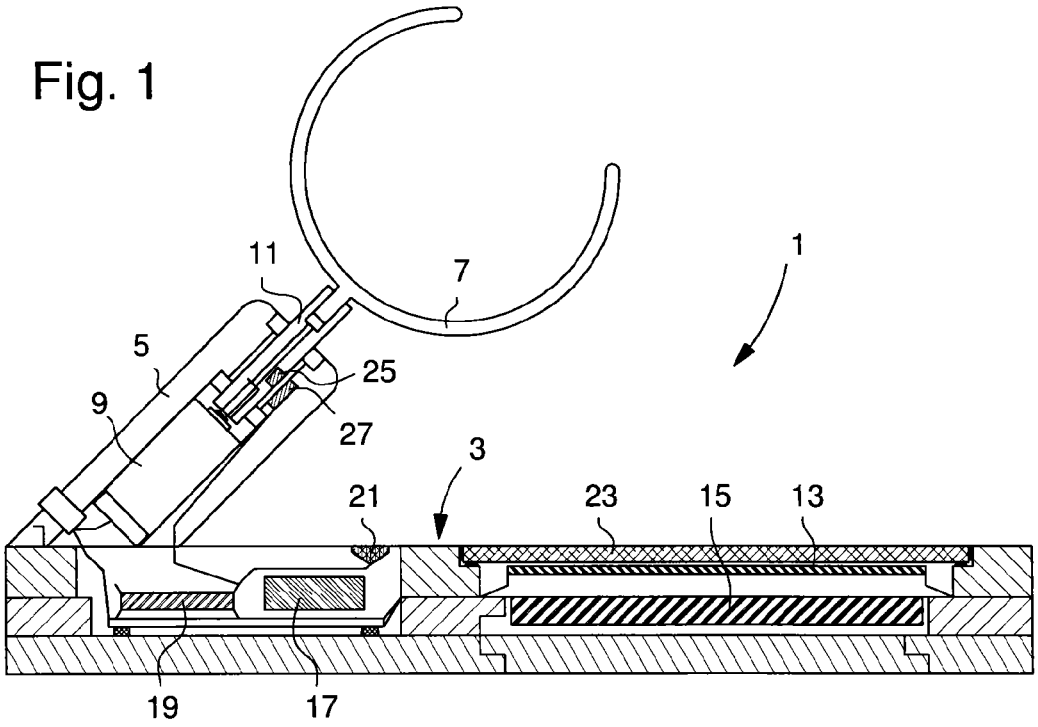
FIG. 1 is a schematic cross-section of a solar electric watch winder according to a particular embodiment of the present invention.

FIG. 1 is a schematic cross-section of a solar electric watch winder (generally designated by the reference 1) according to the present invention. As seen, winder 1 includes a base 3 which carries an inclined arm 5 which ends in a removable rotating support 7. Inside the arm there is housed a motor module 9 including an electric motor and a reduction gear (not referenced). Rotating support 7 is coupled to the motor module 9 via a silicon tube 11 comprising, at both ends thereof, apertures into which the arbours of the motor module and of the rotating support are friction fitted.

Arm 5 is secured to base 3. A certain number of elements of winder 1 are housed in two cavities arranged in the thickness of the base. A first cavity (unreferenced) is used as a housing for a photovoltaic cell 13 and an accumulator 15. A second cavity (unreferenced) contains a voltage booster circuit 17, a clock microcontroller 19 and a light sensor 21 formed in this example by a photodiode.

The collective operation of the various elements that have just been described is governed by microcontroller 19. First of all, in this example, the photovoltaic cell 13 is a Sunpower© high efficiency solar cell. The voltage supplied by the cell is close to 0.4 volts and depends on both the luminous intensity and the delivered current. A voltage booster circuit 17 is placed at the solar cell output. The function of voltage booster 17 is to convert the very low voltage electrical power delivered by the solar cell into a voltage slightly higher than 3 volts, so that it is compatible, at the same time, with accumulator 15, microcontroller 19 and motor module 9.

Figure 2:
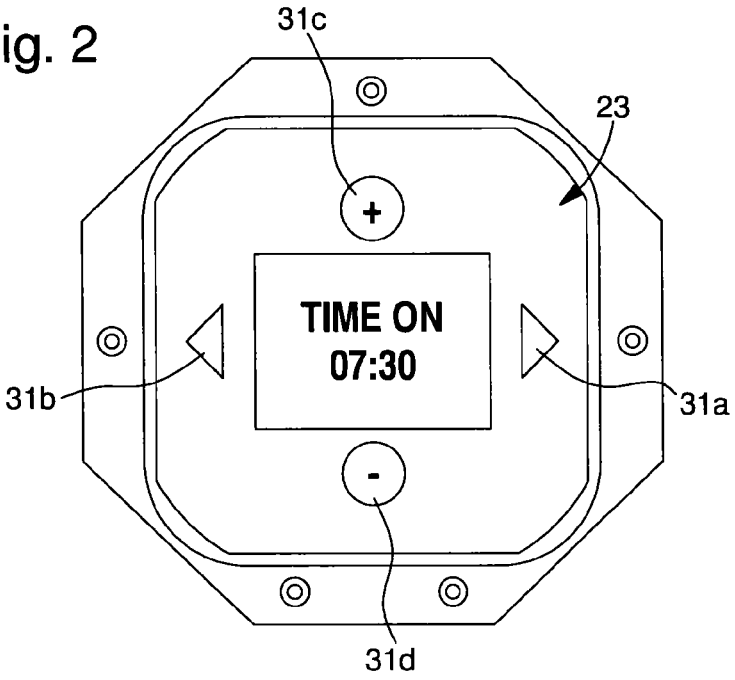
FIG. 2 is a partial top view showing the control interface of the electric winder of FIG. 1.

Microcontroller 19 is also connected to a control interface 23 which is shown in more detail in FIG. 2. In the illustrated example, the control interface includes a matrix LCD display 29 and four tactile keys 31*a*, 31*b*, 31*c* and 31*d*. The LCD display and tactile keys are all integrated in a transparent screen which closes the first cavity of base 3. When not activated, control interface 23 is perfectly transparent. The ambient light can thus reach solar cell 13 unhindered. According to the embodiment of the present example, microcontroller 19 is arranged to selectively execute one or other of a plurality of programmes associated with as many operating modes. Tactile keys 31*a*, 31*b*, 31*c* and 31*d* enable a user to select the desired operating mode.

The first of the operating modes that can be selected is a mode in which the rotating support is driven only when the winder is illuminated. Microcontroller 19 is connected to a photodiode 21 and, to determine whether or not the winder is illuminated, the microcontroller checks the behaviour of the photodiode at regular intervals to establish whether the intensity of the ambient light exceeds a predefined threshold. By way of example, this first operating mode may include the following steps: as soon as the microcontroller determines that the lighting is sufficient, it rotates motor module 9 at the speed of two revolutions per minute, as long as the light intensity does not fall below the predefined threshold. In the event that the light intensity does not weaken, after 12 hours, the motor module will have caused rotating support 7 to complete 1440 revolutions. At that moment, the microcontroller interrupts the winder and changes to sleep mode for the next 12 hours. After the 12 hours in sleep mode, the microcontroller is again placed in standby mode, ready to restart its programme as soon as the lighting is sufficient.

It will be recalled that it is an object of the present invention to provide a solar electric winder able to perform simultaneously the winding and static display functions during the opening hours of a store. For this purpose, a second operating mode that can be selected is a mode in which a programme of driving rotating support 7 is started at a preselected time using control interface 23. Therefore, once the second operating mode has been selected, the user can modify the values of certain parameters of the winding programme using control interface 23. These parameters include, in particular, the time at which the drive programme for rotating support (7) has to start. In the present example, the user first of all uses the tactile keys 31*a* and 31*b* (FIG. 2) to select the parameter to be adjusted. He then uses tactile keys 31*c* and 31*d* to modify the value of that parameter.

It will be clear, in particular, that by selecting the start time of the rotating support drive programme so that the programme occurs entirely outside the store opening hours, it is possible to use the winder as a static display for the entire duration of the opening hours. It should be specified that the presence of accumulator 15 allows a complete winding programme to be executed, even at night, in the absence of any lighting of photovoltaic cell 13.

Preferably, the second operating mode above allows the control interface to be used not only to select the start time of the drive programme, but also to define a certain number of parameters of said programme. It will be evident that one parameter which it is particularly advantageous to be able to define on a case-by case-basis, is the duration of the winding programme. Alternatively, instead of defining the winding duration, it is equally possible to define the number of revolutions that rotating support 7 has to make during the winding programme.

The duration or number of revolutions made during the winding programme depends on the model of the self-winding watch that has to be wound. Thus, a preferred variant of the present invention enables a user to input an indication of the watch model into control interface 23. Thus, simply indicating to electronic means 19 the model of the watch secured to rotating support 7, enables the electronic means to determine the duration or number of revolutions to be performed by the rotating support. According to one possible variant, the watch model may be indicated by inputting a corresponding code into control interface 23. According to this latter variant, the electric winder includes a non-volatile memory associated with microcontroller 19. This memory contains a reference table matching each watch model with an identification code on the one hand, and a number of revolutions or winding duration on the other hand. Thus, a user can programme the number of revolutions or the winding duration simply by entering the identification code of a watch model in control interface 23. It will also be clear to those skilled in the art that, according to another variant, the manual entry of the watch model indication could be replaced by semi-automated entry. Indeed, control interface 23 could include, for example, a bar code or RFID reader device. In these conditions, if the watch, or rather its packaging, contained an RFID tag, or bar code identification, the user would only have to place the identification near the reader device to input the watch model indication into electronic means 19.

Another winding parameter which could be selected by the user of the winder by means of the control interface (23) is the direction of winding. This parameter could, for example, have one of three values: "clockwise rotation", "anti-clockwise rotation", and "alternate winding" (this latter option could, for example, be implemented in the form of a sequence of 10 minutes winding in one direction, then 10 minutes in the other direction, and so on).

According to yet another advantageous variant of the invention, the winder may have the feature of stopping the rotation of rotating support 7 in a clearly defined angular position at the end of the programme. This latter feature notably allows for a winder wherein the watch is always in the vertical position when the winding programme finishes. To stop the rotation in a clearly defined angular position, a solar electric watch winder according to this latter variant includes a means of detecting at least one angular position of rotating support 7. This means of detection may include, for example, a permanent magnet 25 set in the wall of silicon tube 11 and a reed contactor 27 connected to microcontroller 19 and arranged inside arm 5 facing the circular trajectory of magnet 25. The force of the magnet and the sensitivity of the contactor are selected such that contactor 27 closes briefly when magnet 25 passes before it and remains open the rest of the time. It will also be clear that it is possible for the means of detecting at least one angular position of the rotating support to not be magnetic. Indeed, this detection means could equally include, for example, a photodiode and a light source.

It will also be clear that various alterations and/or improvements evident to those skilled in the art may be made to the embodiment described herein without departing from the scope of the present invention defined by the annexed claims. In particular, the light detector connected to the electronic means according to the invention could be formed by the photovoltaic cell 13 connected to microcontroller 19. In this case, it is the existence or absence of a voltage exceeding a certain threshold between the terminals of the photovoltaic cell which would be used to determine whether or not the winder is illuminated.

Moreover, the electric winder could also be fitted with a means for detecting the presence of a watch on rotating support 7. This latter means would be connected to the electronic means and would keep the electric winder in sleep mode when no watch is placed on the rotating support. Thus, the rotating support would only be driven when a watch is on the rotating support. This feature would prevent energy being wasted by rotating the motor needlessly. The means of detecting the presence of a watch on the rotating support could include, for example, an optical sensor or a pressure sensor.

What is claimed is:

1. A solar electric winder for a self-winding watch including:

a rotating support, a motor arranged to drive the rotating support, an accumulator arranged to power the motor, a solar cell arranged to charge the accumulator, an internal clock, an electronic means of controlling the motor, and a user control interface for the electronic means;

wherein the winder includes a light sensor connected to the electronic means, and wherein the electronic means is connected to the internal clock and arranged to be controlled by the user to be selectively placed in one or other of a plurality of operating modes, said plurality of operating modes including a first mode in which the rotating support is only driven when the winder is illuminated and a second mode in which a programme for driving the rotating support is started at a pre-selected time by using the control interface.

2. The electric winder according to claim 1, wherein the user control interface for the electronic means includes a matrix LCD display and a plurality of tactile keys, the LCD display and the tactile keys all being integrated in a transparent screen, and wherein the solar cell is arranged in a housing arranged inside the electric winder, the housing being closed by the transparent screen.

3. The electric winder according to claim 1, wherein the winder is arranged so that, when the user has operated the electronic means to place said means in the second operating mode, the user can define the start time for the rotating support drive programme, and wherein the control interface is arranged to allow the entry of an indication representing the number of revolutions to be performed by the rotating support during the rotating support drive programme.

4. The electric winder according to claim 3, wherein the electronic means includes a non-volatile memory in which there is stored a reference table containing identification codes for various self-winding watch models and matching each of said identification codes to a number of revolutions to be performed or a duration of the rotating support drive programme, and wherein the indication representing the number of revolutions to be performed by the rotating support during the programme is formed by an identification code peculiar to a self-winding watch model.

5. The electric winder according to claim 4, wherein the control interface includes a bar code or RFID reader device, and wherein the watch to be wound is stored with a bar code or RFID tag containing the model identification code of the watch to be wound, the bar code or RFID reader device being arranged to read the bar code or RFID tag stored with the watch to be wound.

6. The electric winder according to claim 1, wherein the winder includes a means of detecting at least one angular position of the rotating support.

* * * * *